US005645126A

United States Patent [19]

Nishishita et al.

[11] Patent Number: 5,645,126

[45] Date of Patent: Jul. 8, 1997

[54] LAMINATED HEAT EXCHANGER

[75] Inventors: Kunihiko Nishishita; Takashi Sugita, both of Konan, Japan

[73] Assignee: Zexel Corporation, Tokyo, Japan

[21] Appl. No.: 531,381

[22] Filed: Sep. 21, 1995

[30] Foreign Application Priority Data

Sep. 22, 1994 [JP] Japan ..... 6-254538

[51] Int. Cl.[6] ..... F28D 1/03

[52] U.S. Cl. ..... 165/153; 165/176; 165/906

[58] Field of Search ..... 165/134.1, 153, 165/176, 906, 174

[56] References Cited

U.S. PATENT DOCUMENTS

| | | | |
|---|---|---|---|
| 3,976,128 | 8/1976 | Patel et al. . | |
| 4,274,482 | 6/1981 | Sonoda . | |
| 4,775,006 | 10/1988 | Hesse | 165/174 X |
| 5,024,269 | 6/1991 | Noguchi et al. . | |
| 5,042,577 | 8/1991 | Suzumura . | |

FOREIGN PATENT DOCUMENTS

| | | | |
|---|---|---|---|
| 704537 | 2/1965 | Canada | 165/174 |
| 288497 | 12/1987 | Japan | 165/153 |
| 356690 | 12/1992 | Japan | 165/176 |

*Primary Examiner*—Leonard R. Leo

*Attorney, Agent, or Firm*—Wenderoth, Lind & Ponack

[57] ABSTRACT

In a laminated heat exchanger in which a heat exchanging medium flows into a specific tank portion via a communicating passage that is connected to a surface that is at a right angle to the direction of the lamination, a reinforced portion is formed in the tank portion that faces opposite the opening portion of communicating passage (communicating pipe). The reinforced portion minimizes the likelihood of a rupture at the shoal-like bead near the communicating passage, which is provided among shoal-like beads formed in an area where the tank portions change to a U-shaped passage portion.

7 Claims, 10 Drawing Sheets

LAMINATED HEAT EXCHANGER

BACKGROUND OF THE INVENTION

1. Field of the Invention

The present invention relates to a laminated heat exchanger formed by laminating tube elements and fins alternately over a plurality of levels and which is used in the cooling cycle of an air conditioning system for vehicles.

2. Description of the Related Art

This type of laminated heat exchanger, which has been in development by this applicant, is formed by laminating tube elements alternately with fins over a plurality of levels. Each tube element has a pair of tank portions at one side and a U-shaped passage portion that communicates between the pair of tank portions. Also, in this type of laminated heat exchanger, tank groups that are provided parallel to each other along the direction of the lamination are formed by providing communication between the tank portions of adjacent tube elements and by providing partitions between the tank groups at specific positions thus a specific number of communicating areas are created. For instance, when forming communicating areas so that a heat exchanging medium flows through four passes relative to the airflow path of the laminated heat exchanger by partitioning one of the tank groups that are provided parallel to each other, two communicating areas A and B are formed in the tank group on one side and, in the other tank group, a communicating area C is formed, which communicates throughout without a partition. With this, a heat exchanging medium flow path extends from the communicating area A through the U-shaped passage portions to the tank group in the communicating area C which corresponds to the tank group in the communicating area A, and then extends from this tank group in the communicating area C to the tank group in the communicating area C that corresponds to the tank group in the communicating area B. Then, from the tank group in the communicating area C, it extends through the U-shaped passage portions to reach the communicating area B. In this case, if the intake and outlet portions for the heat exchanging medium are to be formed on one of the side surfaces of the heat exchanger, a communicating passage that connects an intake and outlet portion to a tank group located further away from the intake and outlet portions of the heat exchanging medium flow path mentioned earlier is required. In the prior art they are connected by a communicating pipe provided between a pair of tank groups that lie parallel to each other along the direction of lamination.

In addition, each of the tube elements is formed by bonding two formed plates, and in order to induce the heat exchanging medium into the U-shaped passage portion, a plurality (for instance, three) of shoal-like beads are formed in the area where the tank portion changes to the U-shaped passage portion. The shoal-like beads formed in each formed plate are bonded flush to each other to form heat exchanging medium guide channels.

To be more specific, as shown in FIG. 11, an enlarged tank portion 7*a*, to which the communicating passage is connected, is formed by extending a tank portion 7 into the space between the tank portions, and a connecting pipe 28, which functions as the communicating passage described earlier, is inserted into the enlarged tank portion 7*a*. With this, fluid that flows into the enlarged tank portion 7*a* from the communicating pipe 28 reaches the area that faces opposite the opening portion of the communicating pipe 28, where it changes direction by 90°, and then is induced into the adjacent tank portion 7, from which it flows into the U-shaped passage portion by travelling through the heat exchanging medium guide channels 37.

However, with the laminated heat exchanger structured as described above, it has been confirmed through rupture testing, in which a high pressure fluid (a fluid at 30–40 $Kg/mm^2$) is made to flow inside, that a rupture occurs at the shoal-like bead 36*c*, closest to the connecting portion where the communicating passage (the communicating pipe 28) is connected. The main cause for this is that the tank wall portion facing opposite the opening portion of the communicating passage becomes distended by the pressure of the fluid sent from the communicating passage 28, as indicated with the broken line, and with this, the shoal-like bead 36*c* is subjected to a greater force than that applied to the other shoal-like beads 36*a* and 36*b*, which tends to break the bond.

SUMMARY OF THE INVENTION

The object of the present invention is to prevent a rupture in the bonded portion where the shoal-like beads are bonded in a laminated heat exchanger in which heat exchanging medium flows through via a communicating passage connected at a surface that runs at a right angle to the direction of the lamination into a specific tank group, by improving the strength of the area where the communicating passage is connected and where the tank portion is likely to become deformed.

Accordingly, this applicant, through the observation that in the prior art, in the tank portion connected to the communicating passage, there is no contrivance to counter the extra pressure in the area that faces opposite the opening portion of the communicating passage and consequently, that area is easily deformed, causing a rupture in the shoal-like bead closest to the communicating passage, has conceived a way of preventing a rupture in the area where the shoal-like beads are bonded, by providing a stronger shape in the area of the tank portion that faces opposite the opening portion of the communicating passage, to prevent any deformation in that area.

In other words, the present invention is a laminated heat exchanger which is constituted by laminating tube elements, each of which is provided with a pair of tank portions on one side and a U-shaped passage portion communicating between the pair of tank portions, alternately with fins over a plurality of levels, with adjacent tube elements communicating through the tank portions as necessary to allow heat exchanging medium to flow, via a communicating passage connected to a surface that runs at a right angle to the direction of the lamination, into a specific tank portion. In the specific tank portion, the area that faces opposite the opening portion of the communicating passage is reinforced.

The means for reinforcement may be achieved by forming the area of the tank portion that faces opposite the opening portion of the communicating passage into a curved surface, or may be achieved by forming a projection that projects toward the outside or toward the inside in the area of the tank portion that faces opposite the opening portion of the communicating passage.

To be more specific, this projection may be constituted with one projection formed on the reference line that connects the communicating holes in the pair of tank portions of a tube element and another projection that is formed perpendicular to the first projection, or it may be constituted with one projection formed on the reference line that connects the communicating holes in the pair of tank portions of a tube element and two projections formed perpendicular to the first projection. It may also be constituted with one projection formed on the reference line that connects the communicating holes in the pair of tank portions of a tube element and two projections that are extended from the first projection at a specific angle to the first projection, or it may be constituted with one arc-shaped projection formed along the internal surface of the tank portion and another projection linked continuously to the two ends of the arc-shaped projection.

Consequently, according to the present invention, the heat exchanging medium flows into the specific tank portion via the communicating passage, since the area of the specific tank portion that faces opposite the opening portion of the communicating passage is reinforced and is, therefore, less likely to become deformed, the destructive force applied to the shoal-like bead closest to the communicating passage is reduced, making this bead less likely to rupture and achieving the object described above.

BRIEF DESCRIPTION OF THE DRAWINGS

The above and other features of the invention and the concomitant advantages will be better understood and appreciated by persons skilled in the field to which the invention pertains in view of the following description given in conjunction with the accompanying drawings which illustrate preferred embodiments. In the drawings.

DETAILED DESCRIPTION OF THE PREFERRED EMBODIMENTS

The following is an explanation of the embodiments of the present invention in reference to the drawings.

Figure 1A:
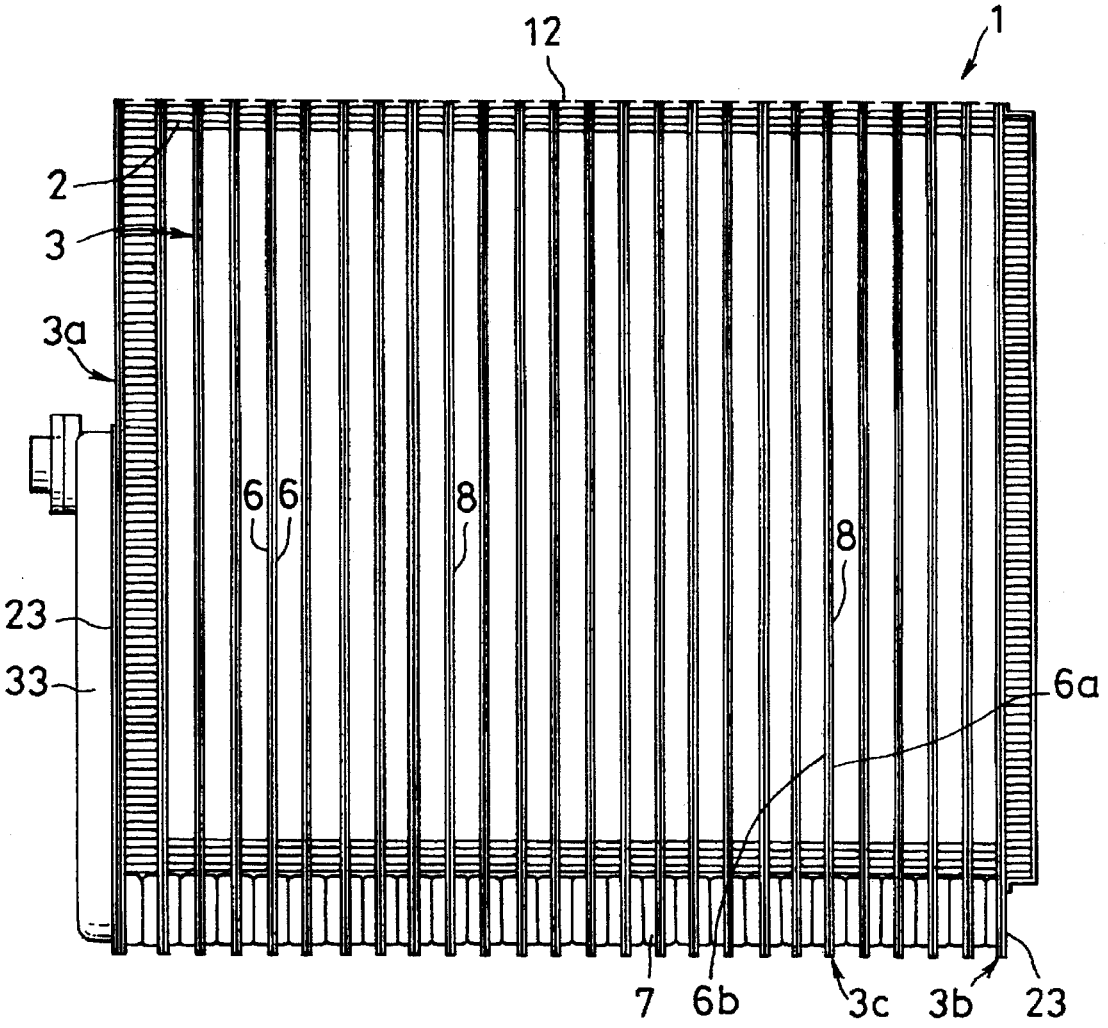
FIG. 1 shows an embodiment of the laminated heat exchanger, with FIG. 1A showing a front view and FIG. 1B showing the bottom view of the heat exchanger.
Figure 1B:
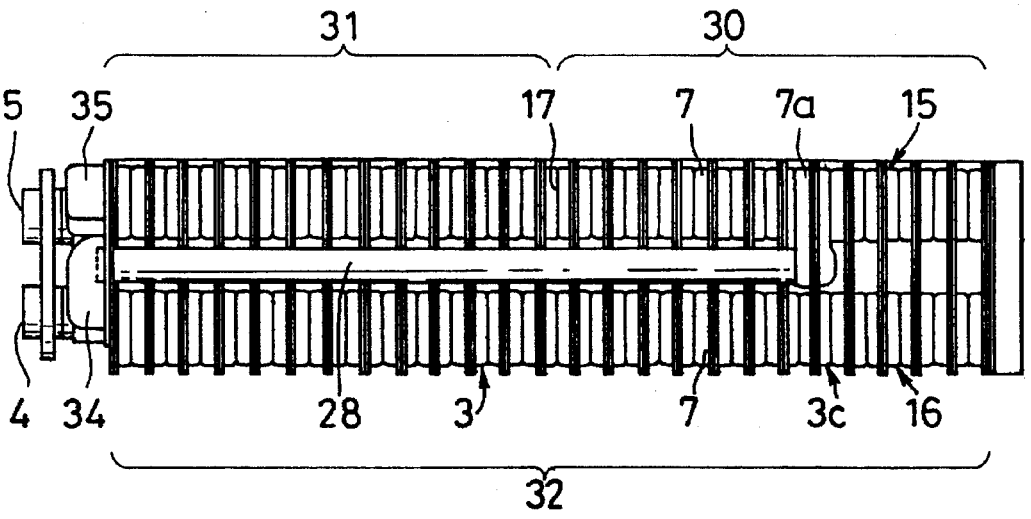

As shown in FIGS. 1A and 1B, a laminated heat exchanger 1 is, for instance, a 4-pass system evaporator formed by laminating fins 2 and tube elements 3 alternately over a plurality of levels and is provided with an intake portion 4 and an outlet portion 5 for a heat exchanging medium at one end in the direction in which the tube elements 3 are laminated. Each tube element 3 is formed by bonding two formed plates 6 shown in FIG. 2 face-to-face, except for the tube elements 3*a* and 3*b* at the two ends in the direction of the lamination and a tube element 3*c*, which is provided with an enlarged tank portion, to be explained later.

Each formed plate 6 is formed by press machining an aluminum plate, with two bowl-like distended portions 9 for tank formation formed at one end and a U-shaped distended portion 10 for passage formation formed continuous with the tow distended portions. An indented portion 29 where a communicating pipe, to be explained later, is to be mounted, is formed between the distended portions 9. A projection 11, which extends from the space between the two distended portions for to the vicinity of the other end of the formed plate 6, is formed in the distended portion 10 for passage formation. Also, at the other end of the formed plate 6, projecting tabs 12 (shown in FIG. 1A) are provided for preventing the fins 2 from falling out during assembly, prior to brazing.

The distended portions 9 for tank formation are formed with a greater distension than the distended portion 10 for passage formation, and the projection 11 is formed on the same plane as the bonding margin of the formed plate peripheral edge, so that when two formed plates 6 are bonded at the edges, their projected portions 11 are also bonded, with a pair of tank portions 7 and 7 being thereby formed by the distended portions 9 which face opposite each other and a U-shaped passage portion 8 which communicates between the tank portions also being thereby formed by the distended portions 10 which face opposite each other.

Figure 2:
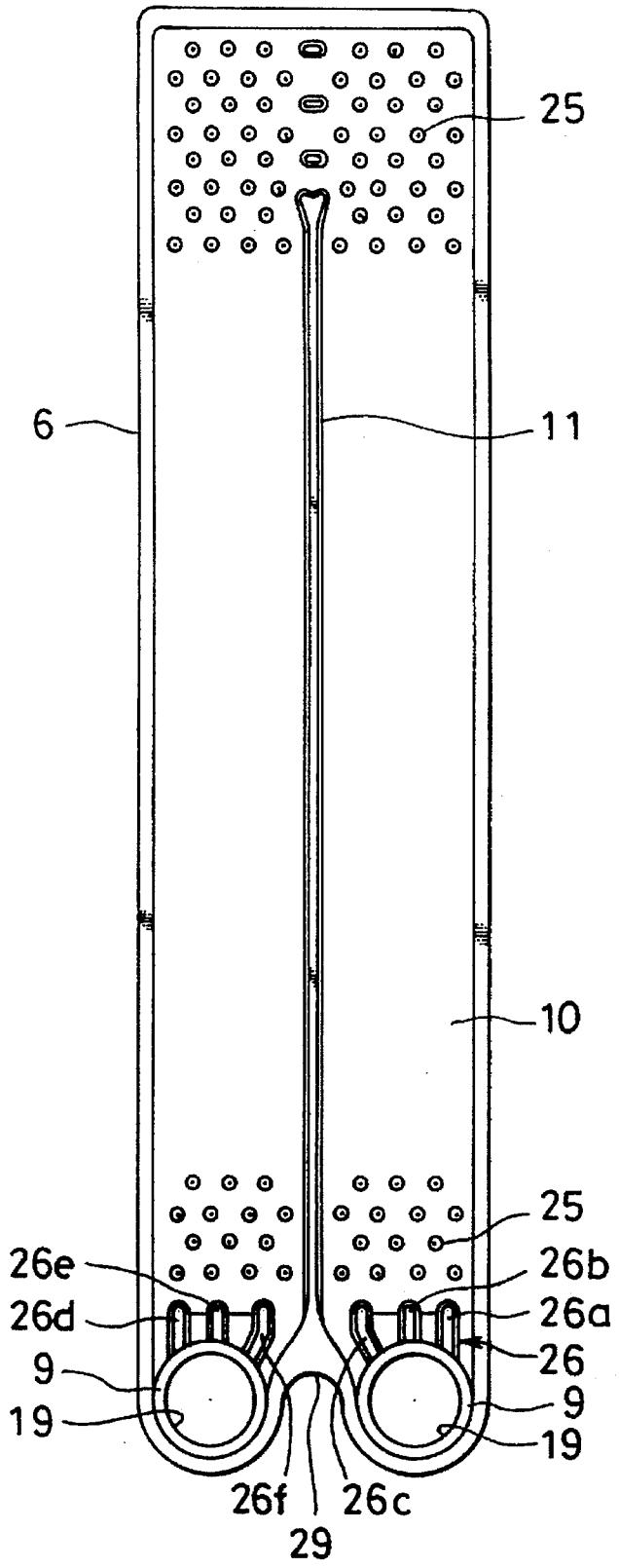
FIG. 2 shows a formed plate used to constitute a typical tube element used in the laminated heat exchanger in FIG. 1.

The tube elements 3*a* and 3*b* at the two ends in the direction of the lamination are each constituted by bonding a flat end plate 23 to the formed plate 6 shown in FIG. 2.

Figure 3A:
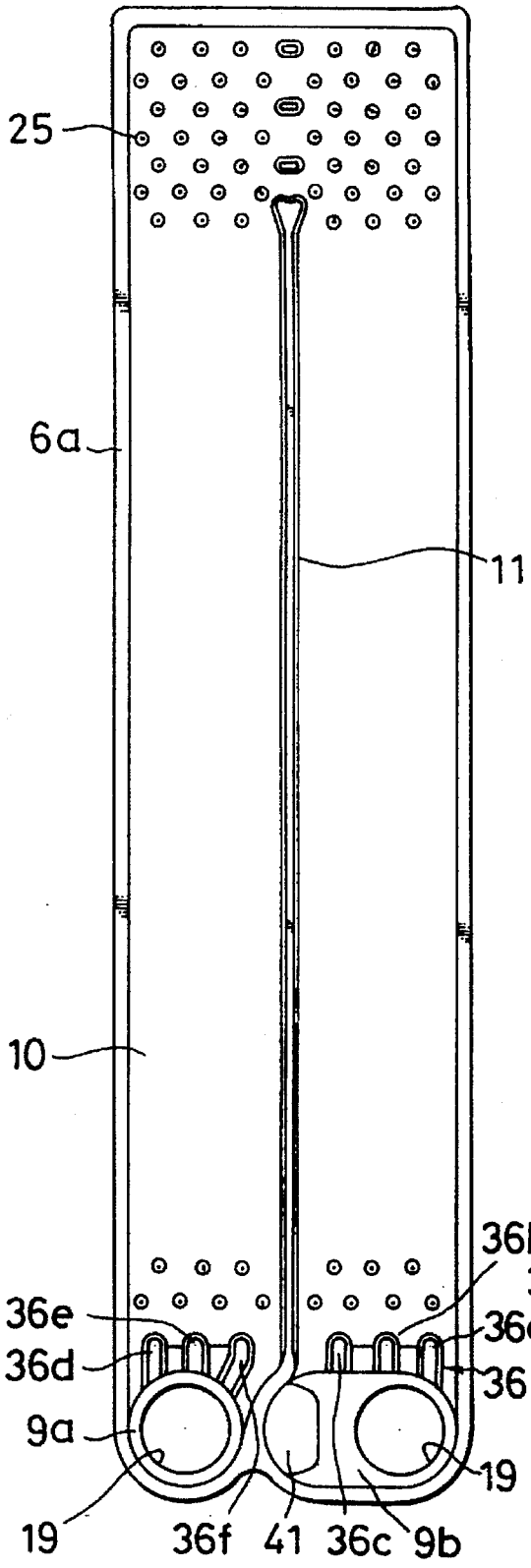
FIGS. 3A and 3B show the formed plates that constitute a tube element that is provided with an enlarged tank portion an used in the laminated heat exchanger in FIG. 1.
Figure 3B:
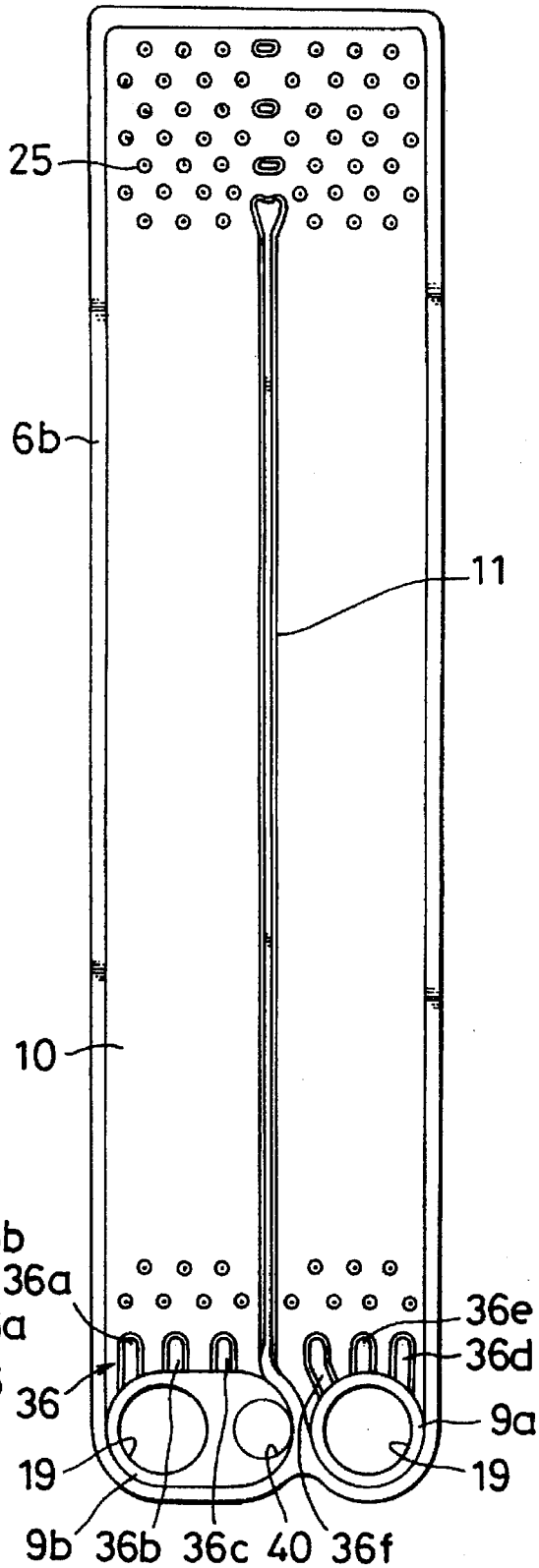

In addition, as shown in FIG. 3, formed plates 6*a* and 6*b* forming the tube element 3*c* are formed symmetrically except for a hole 40 and a reinforced portion 41, to be explained later, and they are each provided with two distended portions 9*a* and 9*b* for tank formation at one end, with one of them (9*b*), extending into an indented portion 29 so as to fill in the indented portion 29 of the formed plate shown in FIG. 2. All other structural features, such as the distended portion 10 for passage formation formed continuously from the distended portions for tank formation, the projection 11 extending from the space between the distended portions 10 to the vicinity of the other end of the formed plate and the projecting tabs 12 provided at the other end of the formed plate to prevent the fins 2 from falling out, are identical to those of the formed plate 6 shown in FIG. 2.

The formed plate 6*b* is provided with communicating holes 19 on the surfaces of the distended portions 9*a* and 9*b*, which run at a right angle to the direction of the lamination, and it is further provided with a communicating hole 40 in the enlarged distended portion 9*b* on the same surface in which the communicating hole 19 is formed, but in an area toward the center.

The formed plate 6*a* is provided with communicating holes 19 on the surfaces of the distended portions 9*a* and 9*b* that run at a right angle to the direction of the lamination, and it is further provided with a reinforced portion 41 in the enlarged distended portion 9*b* on the same surface as the surface in which the communicating holes 19 are formed, but in an area that is closer to the center, i.e. in an area which faces opposite the communicating hole 40 of the formed plate 6b explained earlier.

Figure 4A:
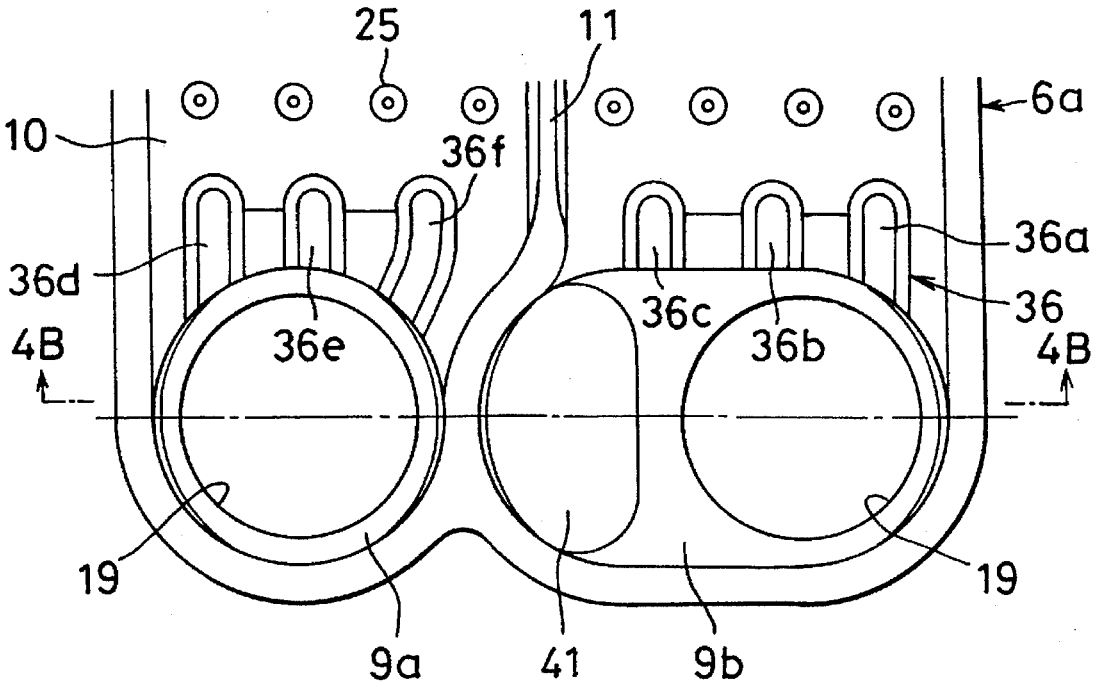
FIG. 4A is an enlargement of a distended portion for tank formation and a portion of the distended portion for passage formation that is continuous from the distended portion in the formed plate shown in FIG. 3A.
Figure 4B:
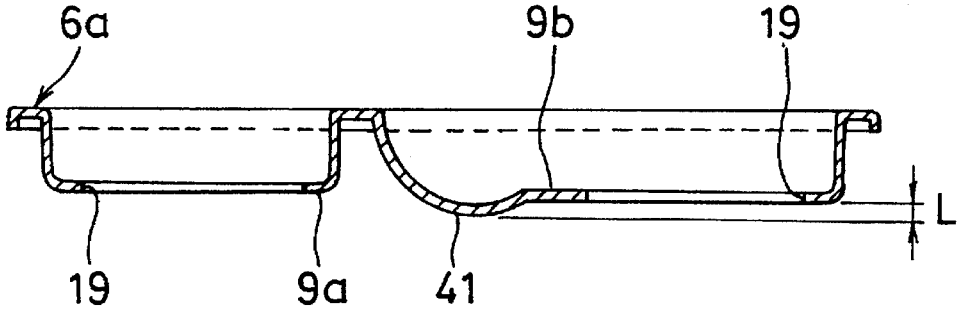
FIG. 4B is a cross section of FIG. 4A through line 4B—4B.

The reinforced portion 41 in this embodiment is formed by distending a part of the distended portion for tank formation 9b toward the outside in the form of a curved surface as shown in FIG. 4, so that it projects out from the surface of the distended portion for tank formation by a specific distance L (1–2 mm).

Figure 5:
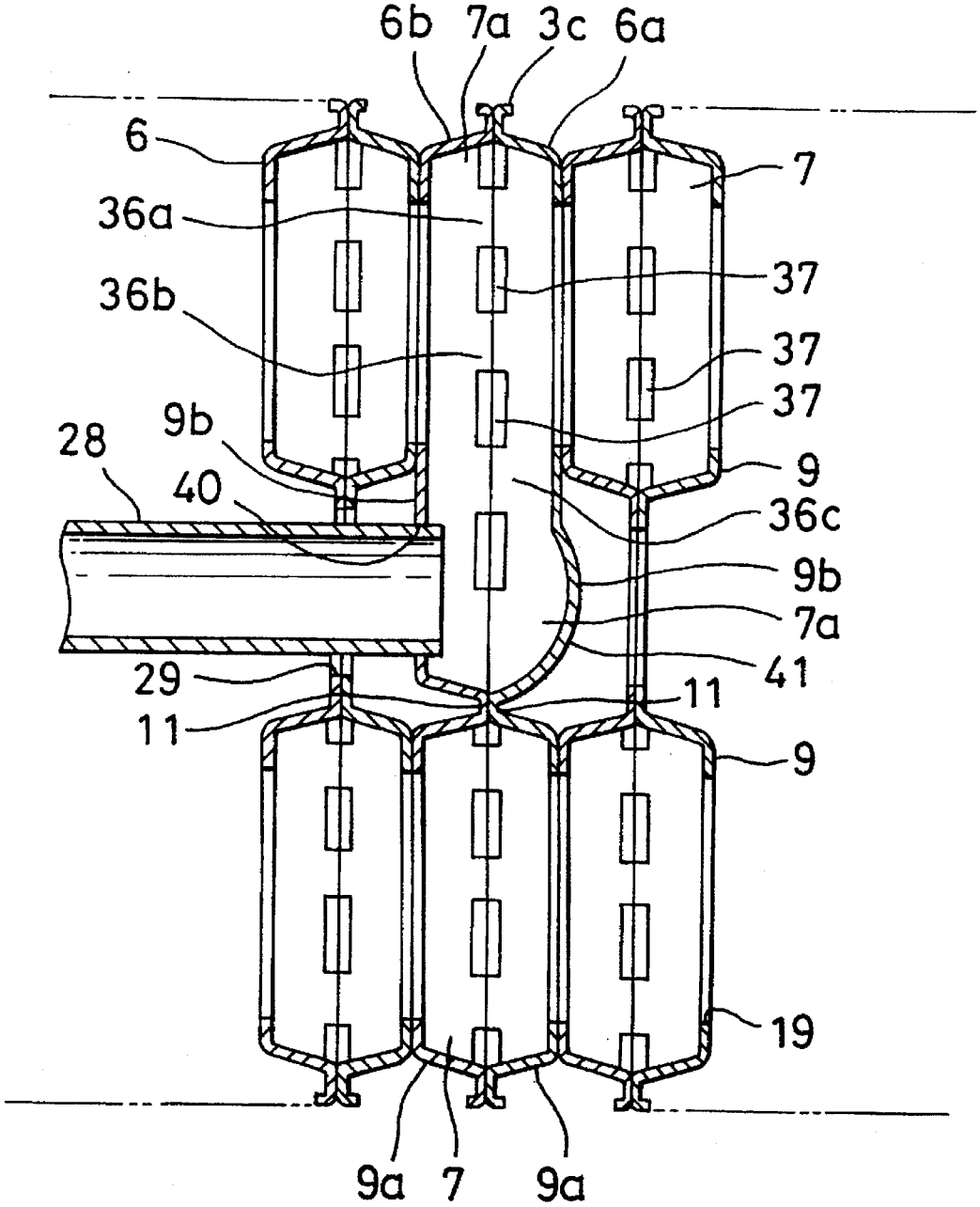
FIG. 5 is a partial enlarged cross section through the enlarged tank portion in the laminated heat exchanger in FIG. 1.

As a result, when the two formed plates 6a and 6b are bonded at their edges, their projections 11 are also bonded, as shown in FIG. 5, and a typical tank portion 7 is formed with the distended portions 9a, and an enlarged tank portion 7a is formed with the distended portions 9b that face opposite each other. A U-shaped passage portion 8 that connects the tank portions is formed with the distended portions 10 that face opposite each other. Note that the tank portion 7 and the U-shaped passage portion 8 are made to communicate with each other via the heat exchanging medium guide channels 37, which are formed by the shoal-like beads 26 (26a–26f) and the shoal-like beads 36 (36a–36f) being bonded to their counterparts. In addition, the communicating hole 40 of the enlarged tank portion 7a is located at a position that faces opposite the reinforced portion 41.

Therefore, as shown in FIG. 1, in the heat exchanger, with the tank portions 7 of adjacent tube elements laminated in the direction of lamination (at a right angle to the direction of airflow), two tank groups, i.e., a first tank group 15 and a second tank group 16, are formed parallel to each other. With this, in the one tank group 15, which includes the enlarged tank portion 7a, each tank portion is in communication with the others via the communicating hole 19 formed in the distended portion 9, and the tank group 15 is also divided into two areas by a partitioning portion 17 located approximately at the center in the direction of the lamination. In the other tank group 16, all the tank portions are in communication through the communicating holes 19 without partitioning.

Consequently, the first tank group 15 is divided by the partitioning portion 17 into a first communicating area 30, which includes the enlarged tank portion 7a, and a second communicating area 31, which communicates with the outlet portion 5. The non partitioned second tank group 16 constitutes a third communicating area 32.

The intake portion 4 and the outlet portion 5 are formed by bonding a plate 33 for intake and outlet passage formation to the end plate 23 located further away from the enlarged tank portion 7. They are provided approximately at the middle of the tube elements 3 in the length direction by an intake passage 34 and an outlet passage 35 formed in the plate 33. In addition, the intake passage 34 and the enlarged tank portion 7a are made to communicate with each other via the communicating pipe 28, which is secured in the indented portion 29. The second communicating area 31 and the outlet passage 35 are made to communicate with each other via a communicating hole (not shown) formed in the end plate 23.

Each of the formed plates 6, 6a and 6b mentioned earlier is provided with a plurality of shoal-like beads 26 (26a–26f) or 36 (36a–36f) in the area that is between the distended portion 10 for passage formation and the distended portions 9 or 9a and 1b for tank formation. In particular, in the tube element 3c, which is provided with the enlarged tank portion 7a, three such beads are formed at each tank portion, as shown in FIGS. 3A, 3B, 4A and 4B. Toward the enlarged tank portion, each of the shoal-like beads 36a–36c is elongated into linear form, running toward the direction in which the U-shaped passage portion extends.

Note that reference number 25 indicates circular beads formed in order to improve the efficiency with which heat exchange is performed. (Although the beads 25 are formed over the entirety of the distended portion for passage formation 10, for the sake of convenience, only a few of them are shown in FIGS. 2 and 3.) When the two formed plates 6 and 6 or 6a and 6b are bonded, each of the beads 25 is bonded to the bead that is formed at a corresponding position on the opposite side.

Figure 6:
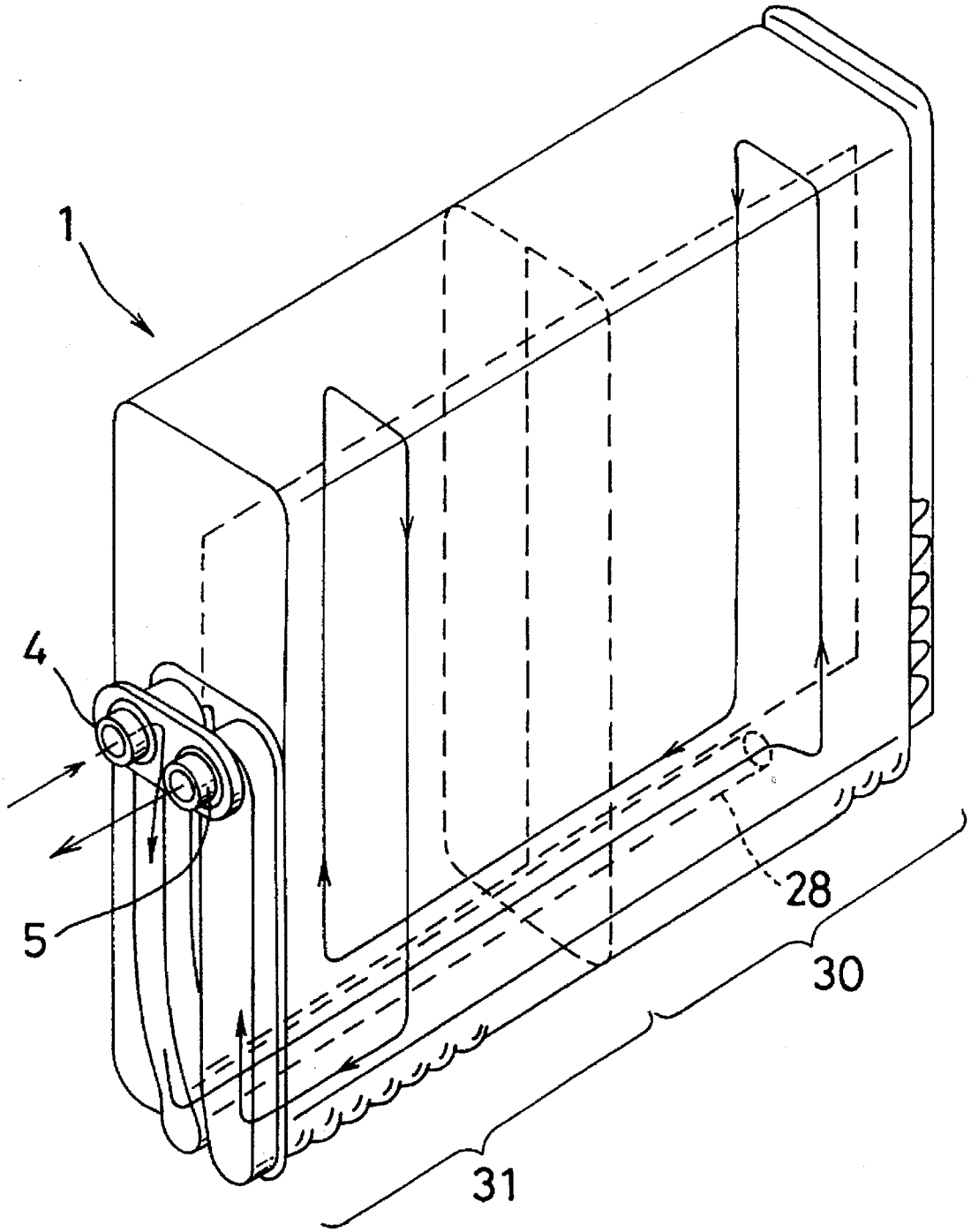
FIG. 6 illustrates the flow of heat exchanging medium in the laminated heat exchanger in FIG. 1.
Figure 7A:
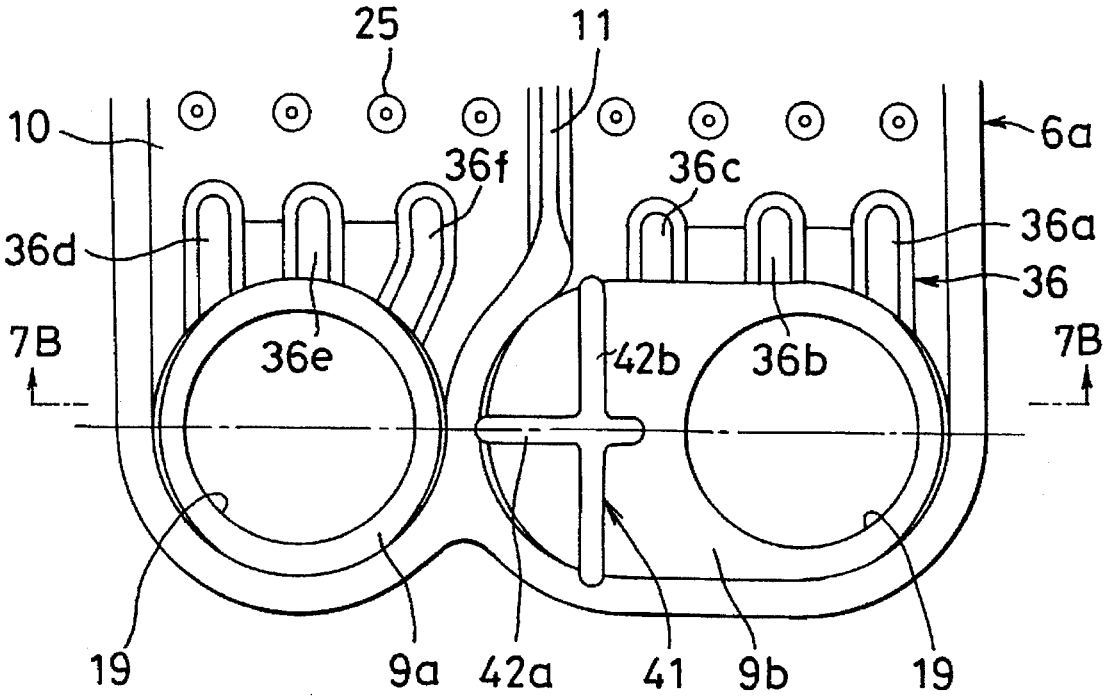
FIGS. 7A and 7B show another example of the reinforced area, with FIG. 7A being an enlargement of a distended portion for tank formation and a portion of the distended portion for passage formation that is continuous from that distended portion for tank formation in the formed plate, and FIG. 7B being a cross section of FIG. 7A through line 7B—7B.
Figure 7B:
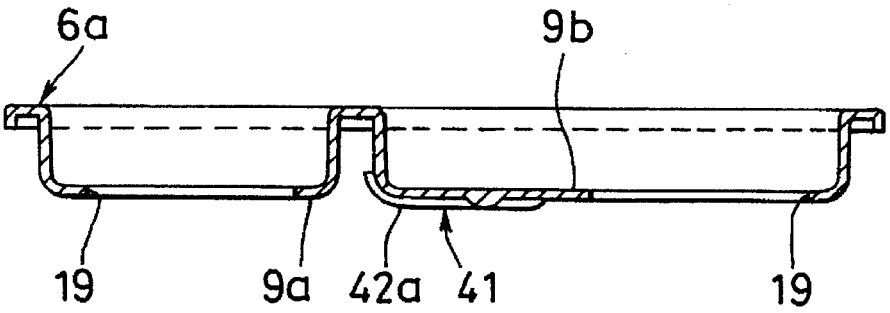

Consequently, the heat exchanging medium that has flowed in through the intake portion 4 travels to the communicating pipe 28 through the intake passage 34 and then enters the enlarged tank portion 7a via the communicating pipe 28. Once the heat exchanging medium is in the enlarged tank portion 7a, it becomes distributed throughout the first communicating area 30 via the communicating holes 19. From the tank group of the first communicating area 30, it travels through the heat exchanging medium guide channels 37 to flow upward through the U-shaped passage portions 8 of the tube elements that correspond to the first communicating area 30 along the projections 11 (first pass). Then the heat exchanging medium makes a U-turn above the projections 11 before travelling downward (second pass) and reaching the tank group on the opposite side (third communicating area 32). Next, it moves to the remaining tank group constituting the third communicating area 32 (the tank group that corresponds to the second communicating area 31) and then travels upward through the U-shaped passage portions 8 of the tube elements along the projections 11 (third pass). Then it makes a U-turn above the projections 11 before travelling downward (fourth pass), to the tank group that constitutes the second communicating area 31. Finally, it flows out from the outlet portion 5 through the outlet passage 35 (see FIG. 6). Thus, the heat in the heat exchanging medium is communicated to the fins 2 while it flows through the U-shaped passage portions 8 that constitute the first through fourth passes, and heat exchange is performed with the air passing between the fins.

When this happens, since the heat exchanging medium delivered from the communicating pipe 28 changes its direction upon impact with the reinforced portion 41 of the formed plate 6a in the enlarged tank portion 7a, the pressure applied to the reinforced portion 41 increases. However, since the reinforced portion 41 is formed as a curved surface, the reinforced portion 41 is not easily deformed even when high pressure fluid strikes the reinforced portion 41, and, therefore; rupture of the shoal-like bead 36c is prevented more effectively, improving the rupture strength by 1–2%.

Alternatively, the reinforced portion 41 formed in the distended portion for tank formation 9b may be constituted by partially providing a projection that projects toward the outside in the distended portion for tank formation 9b.

To be more specific, let us posit a hypothetical reference line (indicated by the 1-point chain line) connecting the centers of the distended portions for tank formation 9a and 9b. One projection 42a may be provided on the reference line where it faces opposite the opening portion of the communicating passage and also a projection 42b, which runs at a right angle to the projection 42a, may be provided.

Figure 8:
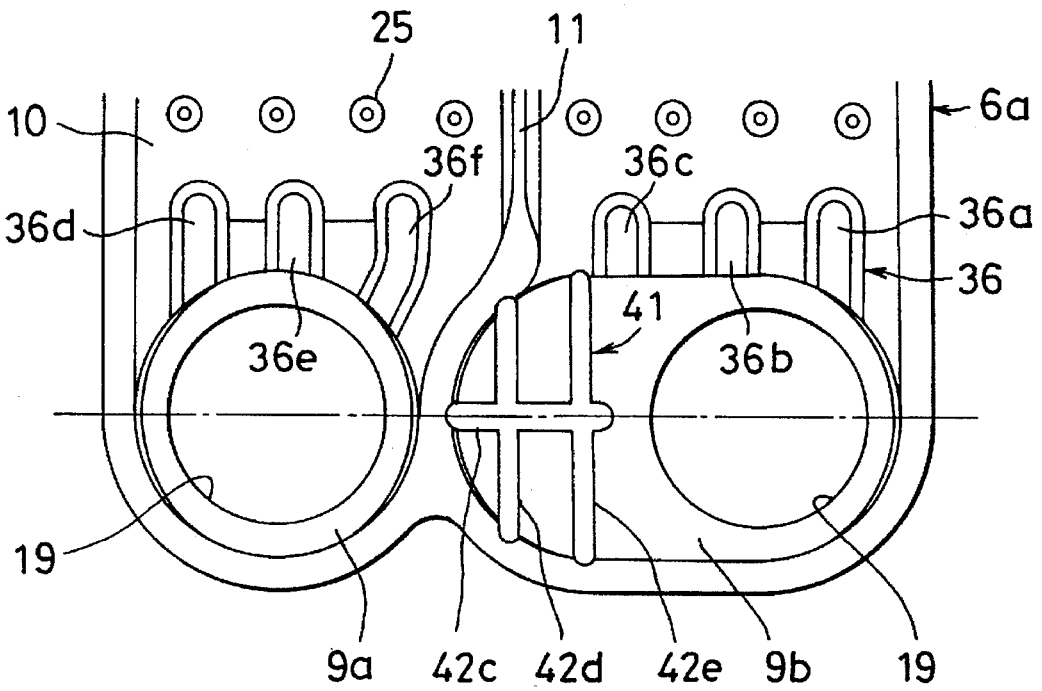
FIGS. 8 and 9 show more examples of the reinforced area.

Now, the reinforced portion 41 shown in FIG. 8 is constituted by forming one projection 42c on the reference line and by forming two projections 42d and 42e running at a right angle to the projection 42c.

Figure 9:
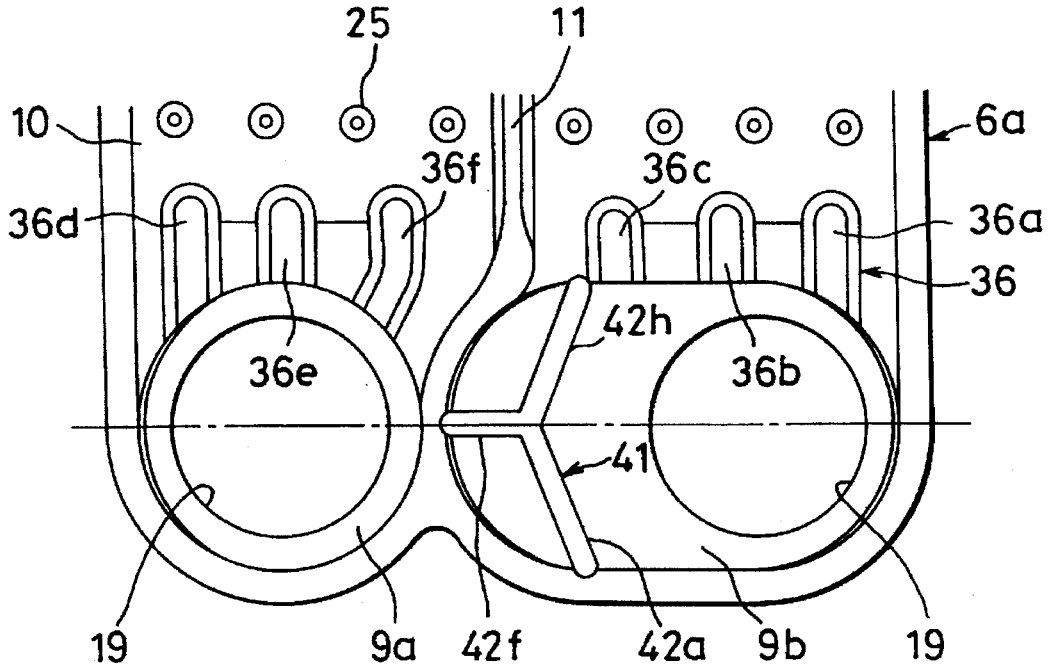

As for the reinforced portion 41 shown in FIG. 9, it is provided with one projection 42*f* on the reference line and projections 42*g* and 42*h* located continuous to the ends of the projection 42*f* and inclined at a specific angle relative to the projection 42*f*. There are still a variety of forms for the reinforced portion 41 possible, and any of these will suffice, as long as the area that faces opposite the opening portion of the communicating passage is reinforced.

Figure 10A:
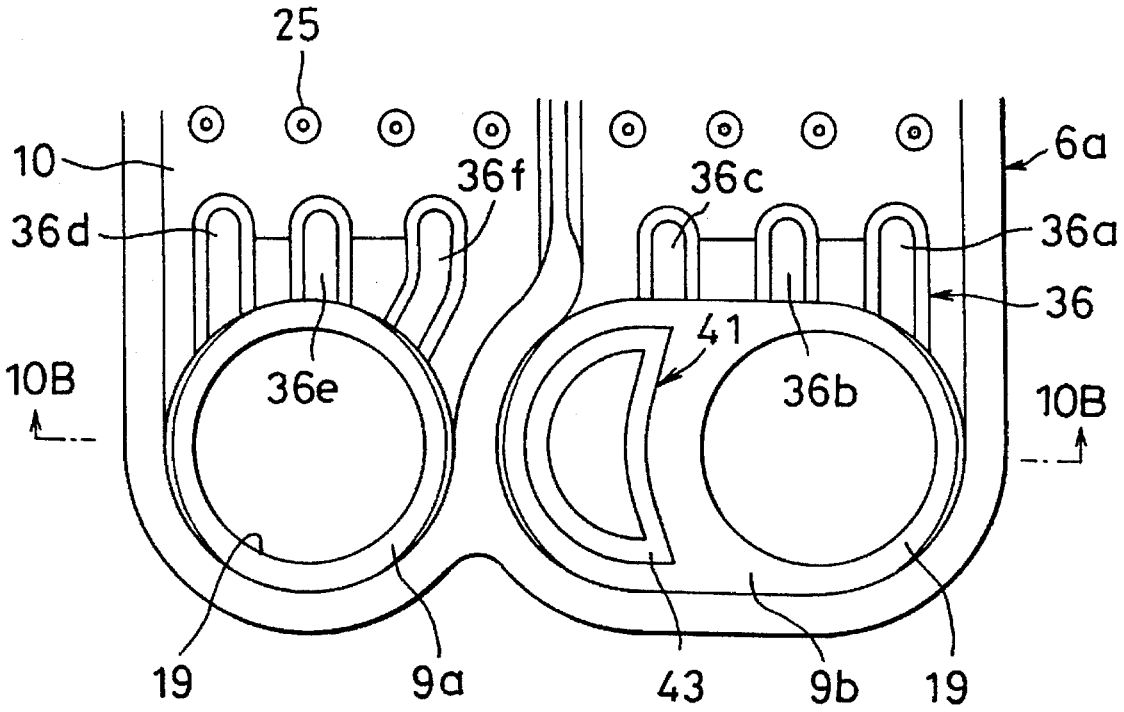
FIGS. 10A and 10B show still more examples of the reinforced area, with FIG. 10A being an enlargement of a distended portion for tank formation and a portion of the distended portion for passage formation that is continuous from that distended portion for tank formation in the formed plate, and FIG. 10B being a cross section of FIG. 10A through line 10B—10B.
Figure 10B:
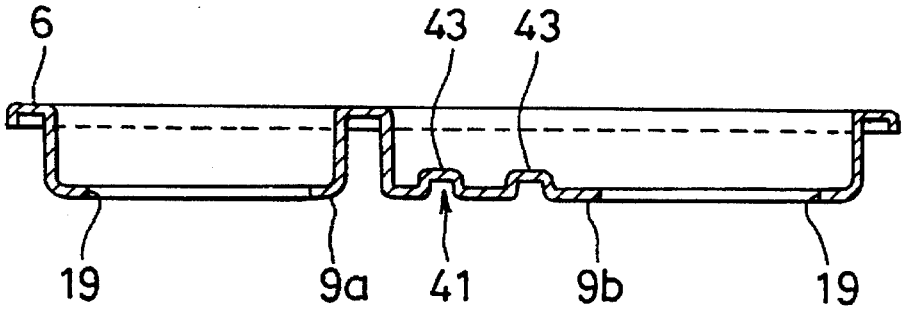
Figure 11:
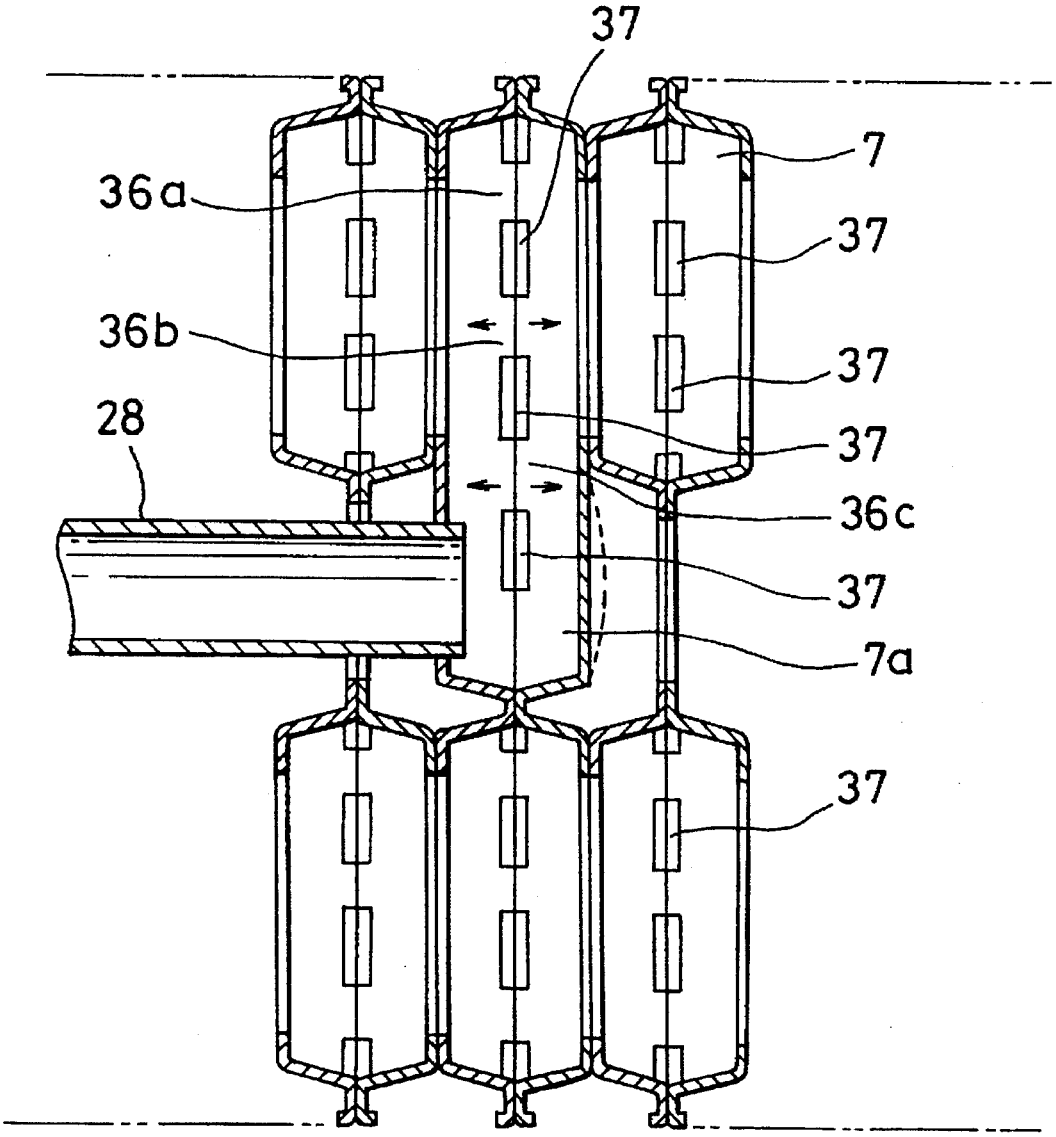
FIG. 11 PRIOR ART
FIG. 11 is a partial enlarged cross section of the area that includes the enlarged tank portion in a heat exchanger in the prior art.

Moreover, as shown in FIG. 10, the reinforced portion 41 of the distended portion for tank formation 9*b* may be constituted with a projection 43 that has a half moon outline, projecting toward the inside of the distended portion 9*b*. Specifically, the projection 43 is constituted by a half-moon projection formed along the internal circumference of the tank portion and another projection that is roughly linear and which lies continuous to the ends of the first projection.

While, in FIG. 10, an example of the reinforced portion that is formed circularly around the area that faces opposite the opening portion of the communicating passage is shown, in this case too, projections can be formed in any way whatsoever, so long as the area of the distended portion for tank formation that faces opposite the opening portion of the communicating passage is reinforced. Furthermore, while the reinforced portions shown in FIGS. 7A, 7B, 8, 9 and 10 are all formed by projecting out toward the outside from the surface of the tank portion of the tube element, similar advantages are achieved with reinforced portions that are formed by projecting toward the inside from the surface of the tank portion of the tube elements.

Note that the explanation has been given so far, in reference to the embodiments, of tube elements used in an evaporator, but it is obvious that similar effects and advantages are achieved in other laminated type heat exchangers if they are structured similarly.

As has been explained, according to the present invention, since the communicating passage is connected to a specific tank group at a surface that runs at a right angle to the direction of the lamination of the tube elements and the area that faces opposite the opening portion of the communicating passage is reinforced, the reinforced portion becomes less easily deformed and the strength of the tank portion is improved.

Moreover, as a result of preventing any deformation in the area that faces opposite the opening portion of the communicating passage, among the shoal-like beads that are formed in the area where the tank portions become the U-shaped passage portion, the shoal-like bead that is formed closest to the communicating passage, in particular, becomes less likely to rupture, improving the rupture strength.

What is claimed is:

1. A laminated heat exchanger comprising:

a tank assembly comprising a plurality of fluidly connected tube elements, said assembly having a first end and a second end, and each said tube element comprising a pair of tanks and a U-shaped passage communicating said pair of tanks;

fins positioned between said tube elements of said assembly;

a first end plate structure positioned at said first end of said tank assembly defining coolant inlet and outlet passageways;

a second end plate structure at said second end of said tank assembly;

said assembly defining a pair of tank groups that each comprises said tanks of said pairs of tanks of said tube elements that are communicated with each other between said first end plate structure and said second end plate structure and a plurality of communicating areas that are defined by partitioning said pair of tank groups at a specified position;

wherein one of said tanks of a said pair of tanks of said tube elements is larger than others of said tanks, said one of said tanks comprising a tank portion that has an opening portion and a reinforced portion located at a position facing opposite to said opening portion; and a communicating pipe communicating said coolant inlet passage with one of said communicating areas, said communicating pipe being inserted into said opening portion of said tank portion of said one of said tanks;

wherein said reinforced portion comprises a projection on an outer surface of said tank portion that projects outwardly of said tank portion;

wherein said pairs of tanks of said tube elements have pairs of communicating holes therein; and wherein said projection comprises a first projection that is located on a reference line that connects said pairs of communicating holes as seen in the direction of lamination and a second projection that is perpendicular to said first projection.

2. A laminated heat exchanger as claimed in claim 1, wherein:

said projection further includes a third projection that is perpendicular to said first projection and parallel to said second projection.

3. A laminated heat exchanger comprising:

a tank assembly comprising a plurality of fluidly connected tube elements, said assembly having a first end and a second end, and each said tube element comprising a pair of tanks and a U-shaped passage communicating said pair of tanks;

fins positioned between said tube elements of said assembly;

a first end plate structure positioned at said first end of said tank assembly defining coolant inlet and outlet passageways;

a second end plate structure at said second end of said tank assembly;

said assembly defining a pair of tank groups that each comprises said tanks of said pairs of tanks of said tube elements that are communicated with each other between said first end plate structure and said second end plate structure and a plurality of communicating areas that are defined by partitioning said pair of tank groups at a specified position;

wherein one of said tanks of a said pair of tanks of said tube elements is larger than others of said tanks, said one of said tanks comprising a tank portion that has an opening portion and a reinforced portion located at a position facing opposite to said opening portion; and a communicating pipe communicating said coolant inlet passage with one of said communicating areas, said communicating pipe being inserted into said opening portion of said tank portion of said one of said tanks;

wherein said reinforced portion comprises a projection that projects inwardly of said tank portion;

wherein said pairs of tanks of said tube elements have pairs of communicating holes therein; and wherein said projection comprises a first projection that is located on a reference line that connects said pairs of communicating holes as seen in the direction of lamination and a second projection that is perpendicular to said first projection.

4. A laminated heat exchanger comprising:

a tank assembly comprising a plurality of fluidly connected tube elements, said assembly having a first end and a second end, and each said tube element comprising a pair of tanks and a U-shaped passage communicating said pair of tanks;

fins positioned between said tube elements of said assembly;

a first end plate structure positioned at said first end of said tank assembly defining coolant inlet and outlet passageways;

a second end plate structure at said second end of said tank assembly;

said assembly defining a pair of tank groups that each comprises said tanks of said pairs of tanks of said tube elements that are communicated with each other between said first end plate structure and said second end plate structure and a plurality of communicating areas that are defined by partitioning said pair of tank groups at a specified position;

wherein one of said tanks of a said pair of tanks of said tube elements is larger than others of said tanks, said one of said tanks comprising a tank portion that has an opening portion and a reinforced portion located at a position facing opposite to said opening portion, said reinforced portion comprising a projection; and a communicating pipe communicating said coolant inlet passage with one of said communicating areas, said communicating pipe being inserted into said opening portion of said tank portion of said one of said tanks so as to open into said one of said tanks at a position opposite to said projection;

wherein said pairs of tanks of said tube elements have pairs of communicating holes therein; and wherein said projection comprises a first projection that is located on a reference line that connects said pairs of communicating holes as seen in the direction of lamination and a second projection that is perpendicular to said first projection.

5. A laminated heat exchanger as claimed in claim 4, wherein:

said projection further includes a third projection that is perpendicular to said first projection and parallel to said second projection.

6. A laminated heat exchanger comprising:

a tank assembly comprising a plurality of fluidly connected tube elements, said assembly having a first end and a second end, and each said tube element comprising a pair of tanks and a U-shaped passage communicating said pair of tanks;

fins positioned between said tube elements of said assembly;

a first end plate structure positioned at said first end of said tank assembly defining coolant inlet and outlet passageways;

a second end plate structure at said second end of said tank assembly;

said assembly defining a pair of tank groups that each comprises said tanks of said pairs of tanks of said tube elements that are communicated with each other between said first end plate structure and said second end plate structure and a plurality of communicating areas that are defined by partitioning said pair of tank groups at a specified position;

wherein one of said tanks of a said pair of tanks of said tube elements is larger than others of said tanks, said one of said tanks comprising a tank portion that has an opening portion and a reinforced portion located at a position facing opposite to said opening portion, said reinforced portion comprising a projection that projects outwardly of said one of said tanks;

wherein said pairs of tanks of said tube elements have pairs of communicating holes therein; and wherein said projection comprises a first projection that is located on a reference line that connects said pairs of communicating holes as seen in the direction of lamination and a second projection that is perpendicular to said first projection; and a communicating pipe communicating said coolant inlet passage with one of said communicating areas, said communicating pipe being inserted into said opening portion of said tank portion of said one of said tanks so as to open into said one of said tanks at a position opposite to said projection.

7. A laminated heat exchanger as claimed in claim 6, wherein:

said projection further includes a third projection that is perpendicular to said first projection and parallel to said second projection.

* * * * *